US007111419B1

(12) United States Patent
Miller

(10) Patent No.: US 7,111,419 B1
(45) Date of Patent: Sep. 26, 2006

(54) THUMB FOR A BACKHOE

(75) Inventor: John C. Miller, West Olive, MI (US)

(73) Assignee: Rockland, Inc., Bedford, PA (US)

( * ) Notice: Subject to any disclaimer, the term of this patent is extended or adjusted under 35 U.S.C. 154(b) by 65 days.

(21) Appl. No.: 10/343,455

(22) PCT Filed: Jul. 31, 2000

(86) PCT No.: PCT/US00/20687

§ 371 (c)(1),
(2), (4) Date: Sep. 16, 2003

(87) PCT Pub. No.: WO02/10522

PCT Pub. Date: Feb. 7, 2002

(51) Int. Cl.
*E02F 3/96* (2006.01)

(52) U.S. Cl. ..... 37/406; 37/410; 37/903; 414/723; 414/727

(58) Field of Classification Search ..... 37/403, 37/302, 406, 903, 408–410; 414/729, 727, 414/740, 723
See application file for complete search history.

(56) References Cited

U.S. PATENT DOCUMENTS 2,044,624 A * 6/1936 Morgan ..... 414/694
3,275,172 A * 9/1966 Smith ..... 414/694
3,353,285 A * 11/1967 Murray ..... 37/406
3,422,975 A * 1/1969 Oris ..... 414/732
3,477,602 A 11/1969 Peterson
3,807,589 A * 4/1974 Shovick ..... 414/740
4,285,628 A 8/1981 Jankowski ..... 414/739
4,375,345 A * 3/1983 Hanson ..... 414/722
4,407,626 A * 10/1983 Bruckner ..... 414/740
4,466,494 A * 8/1984 Hanson ..... 173/46
4,761,113 A * 8/1988 Smith et al. ..... 414/732
4,803,788 A * 2/1989 Sorenson ..... 37/406
4,932,832 A * 6/1990 McCasland et al. ..... 414/732
4,996,830 A * 3/1991 Davison ..... 56/14.7
5,088,213 A * 2/1992 Raimondo et al. ..... 37/379
5,092,733 A * 3/1992 Kishi ..... 414/718
5,111,602 A * 5/1992 Risch ..... 37/406
5,267,824 A * 12/1993 Kishi ..... 414/718
5,375,348 A 12/1994 Kishi ..... 37/186
5,494,395 A * 2/1996 Raunisto ..... 414/694
5,553,408 A * 9/1996 Townsend ..... 37/406
5,638,616 A * 6/1997 Kishi ..... 37/186
5,649,377 A 7/1997 Tanada ..... 37/406
5,678,332 A * 10/1997 Hawkins ..... 37/403
5,851,101 A * 12/1998 Kim ..... 414/713
5,927,933 A * 7/1999 Tucker ..... 414/729
6,120,237 A * 9/2000 Cummings et al. ..... 414/729
6,203,267 B1 * 3/2001 Heiple et al. ..... 414/722
6,260,294 B1 * 7/2001 Pitcher ..... 37/406
6,640,471 B1 * 11/2003 Desrochers ..... 37/406
6,655,053 B1 * 12/2003 Cummungs ..... 37/403

FOREIGN PATENT DOCUMENTS

CA 2364936 * 6/2005

* cited by examiner

*Primary Examiner*—Thomas A Beach
(74) *Attorney, Agent, or Firm*—Stevens, Davis, Miller & Mosher, LLP

(57) ABSTRACT

A digging implement (10) including an extendable linkage (12) including a bucket (14) and a thumb assembly (34) for holding materials in the bucket (14). The thumb assembly (34) is configured to rotate as the linkage (12) extends, and both the bucket (14) and the thumb assembly (34) are independently operable.

83 Claims, 2 Drawing Sheets

46
60
60
36
48
54
40
48
46
38
42
38
34
56
56
44

46
58
60
36
16
62
68
56
34
52
48
38
200
45

THUMB FOR A BACKHOE

BACKGROUND OF THE INVENTION

A. Field of the Invention

The present invention relates to digging implements, and in particular a backhoe.

B. Background of the Art

Backhoes are used extensively for excavating and for carrying objects from one area to another. Backhoes have typically been used to dig holes in the ground for trenches and for the placement of building structural components, road substructures, cables, pipes, etc.

Heretofore, backhoes have included a first arm pivotally attached to a tractor and a second arm pivotally attached to the first arm in a scissors-like manner. A bucket is attached to the second arm for digging. Separate hydraulic actuators have typically been used to move each of the arms and the bucket. Some of these backhoes have included an extendable second arm. Furthermore, some backhoes have included a gripping device positioned opposite the bucket for gripping objects between the gripping device and the bucket. One of the gripping devices has included a gripping device statically attached to an arm of the backhoe that does not rotate relative to the arm. These gripping devices have been difficult to use because the arm and the bucket have to properly position relative to the gripping device before the gripping device can be used to pick up objects. Another gripping device includes a separate hydraulic actuator for moving only the gripping device. These backhoe are expensive to manufacture because of the cost for the extra hydraulic actuator and the cost for connecting the gripping device to the controls in the tractor. A third gripping device includes thumbs that rotate simultaneously with the bucket. These backhoes are also difficult to use because the bucket and the gripping device must be properly positioned before the gripping implement can be used. Furthermore, these backhoes are difficult to operate because the rotating gripping implement can get in the way of the rotating bucket, thus making the ground difficult to dig.

SUMMARY OF THE INVENTION

In a digging implement of the present invention, a thumb assembly is configured for connection to an extendable linkage having a bucket for holding materials in the bucket. The thumb assembly is also configured to rotate as the linkage extends, wherein both the bucket and the thumb assembly are independently operable.

These and other features, advantages and objects of the present invention will be further understood and appreciated by those skilled in the art by reference to the following specification and claims.

DETAILED DESCRIPTION OF THE PREFERRED EMBODIMENTS

Figure 1:
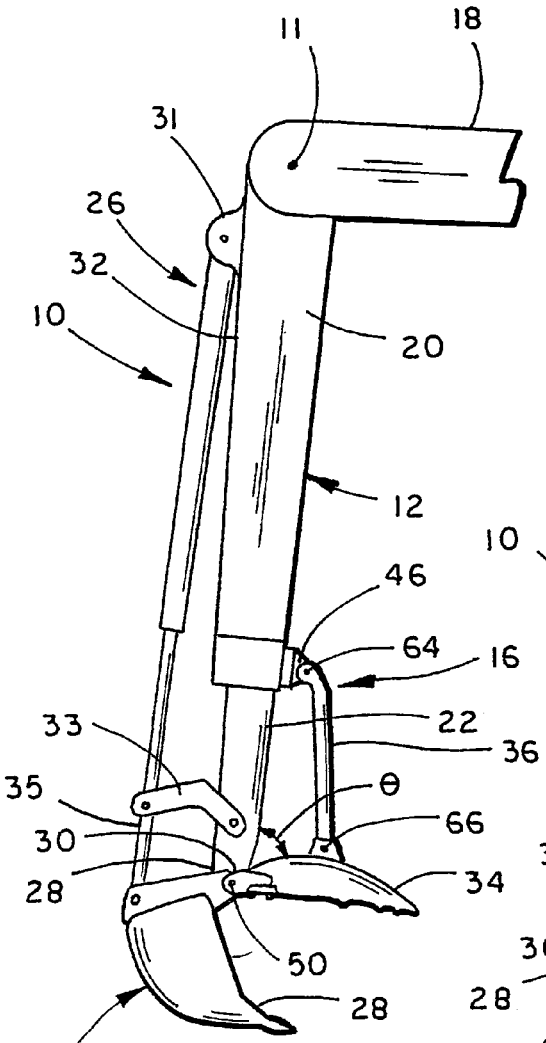
FIG. 1 is a side view of a boom connected to a digging implement in a fully retracted position of the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a digging implement of the present invention. The digging implement 10 includes an extendable linkage 12 having a bucket 14 and a thumb assembly 16 for holding materials in the bucket 14. The thumb assembly 16 is configured to rotate as the linkage 12 extends, and both the bucket 14 and the thumb assembly 16 are independently operable.

In the illustrated example, the digging implement 10 is pivotally connected at a first pivot point 11 to a boom 18 in a scissors-like manner. The boom 18 is configured for pivotal attachment to the rear end of a mobile powered tractor (not shown) for moving the digging implement 10 to various locations. A combination of the tractor, the digging implement 10 and the boom 18 are commonly referred to as a "backhoe." The bucket 14 connected to the digging implement 10 can be extended away from the tractor by rotating the boom 18 downward relative to the tractor and rotating the digging implement 10 upward relative to the boom 18. The digging implement 10 includes the extendable linkage 12, which comprising a first telescoping body 20 and a second telescoping body 22 in which the second telescoping body 22 can be slid relative to the first telescoping body 20 to vary the effective length of the linkage 12 and thus the reach of the bucket 14. The illustrated first telescoping body 20 and the second telescoping body 22 are a pair of concentric telescoping tubes. Although the first telescoping body 20 and the second telescoping body 22 are shown as being hollow and substantially rectangular, it is contemplated that the first telescoping body 20 and the second telescoping body 22 could have any geometric cross-section and the second telescoping body 22 could be solid throughout its cross-section. A telescoping hydraulic actuator (not shown) within the second telescoping body 22 telescopes the second telescoping body 22 outward from the first pivot point 11 within the first telescoping body 20 in order to extend the linkage 12.

The illustrated extendable linkage 12 includes the bucket 14 and a telescoping hydraulic actuator 26 for rotating the bucket 14. The illustrated bucket 14 is pivotally attached to an end 28 of the second telescoping body 22 at a second pivot point 30. An open mouth 28 of the bucket 14 faces the tractor such that the boom 18 and the extendable linkage 12 can move the bucket 14 towards the tractor in order to scoop up dirt or other objects adjacent the tractor. The telescoping hydraulic actuator 26 is connected to a pivot sleeve 31 attached to a top surface 32 of the first telescoping body 20 near the first pivot point 11. The telescoping hydraulic actuator 26 is also pivotally connected to a first arm 33 and a second arm 35. The first arm 33 is further pivotally connected the second telescoping body 22 between the second pivot point 30 and the first telescoping body 20. Likewise, the second arm 35 is further pivotally connected to the bucket 14 at a point offset the second pivot point 30. The telescoping hydraulic actuator 26, the first arm 33 and the second arm 35 are configured to rotate the bucket 14 about the second pivot point 30 greater than 90° around the end 28 of the second telescoping body 22. The telescoping hydraulic actuator 26 can be operated such that the telescoping hydraulic actuator 26 will extend with the second telescoping body 22 while the second telescoping body 22 telescopes within the first telescoping body 20. Therefore, during this operation, the bucket 14 will not rotate relative to the second telescoping body 22 as the linkage 12 extends. Likewise, the telescoping hydraulic actuator 26 can be operated such that the telescoping hydraulic actuator 26 will extend while the second telescoping body 22 remains stationary relative to the first telescoping body 20. Therefore, during this operation, the bucket 14 will rotate towards the tractor and the boom 18. Furthermore, the telescoping hydraulic actuator 26 can be extended at a rate faster or slower than the rate that the second telescoping body 22 telescopes within the first telescoping body 20 such that the linkage 12 will extend and the bucket 14 will rotate relative to the second telescoping body 22.

Figures 3, 4:
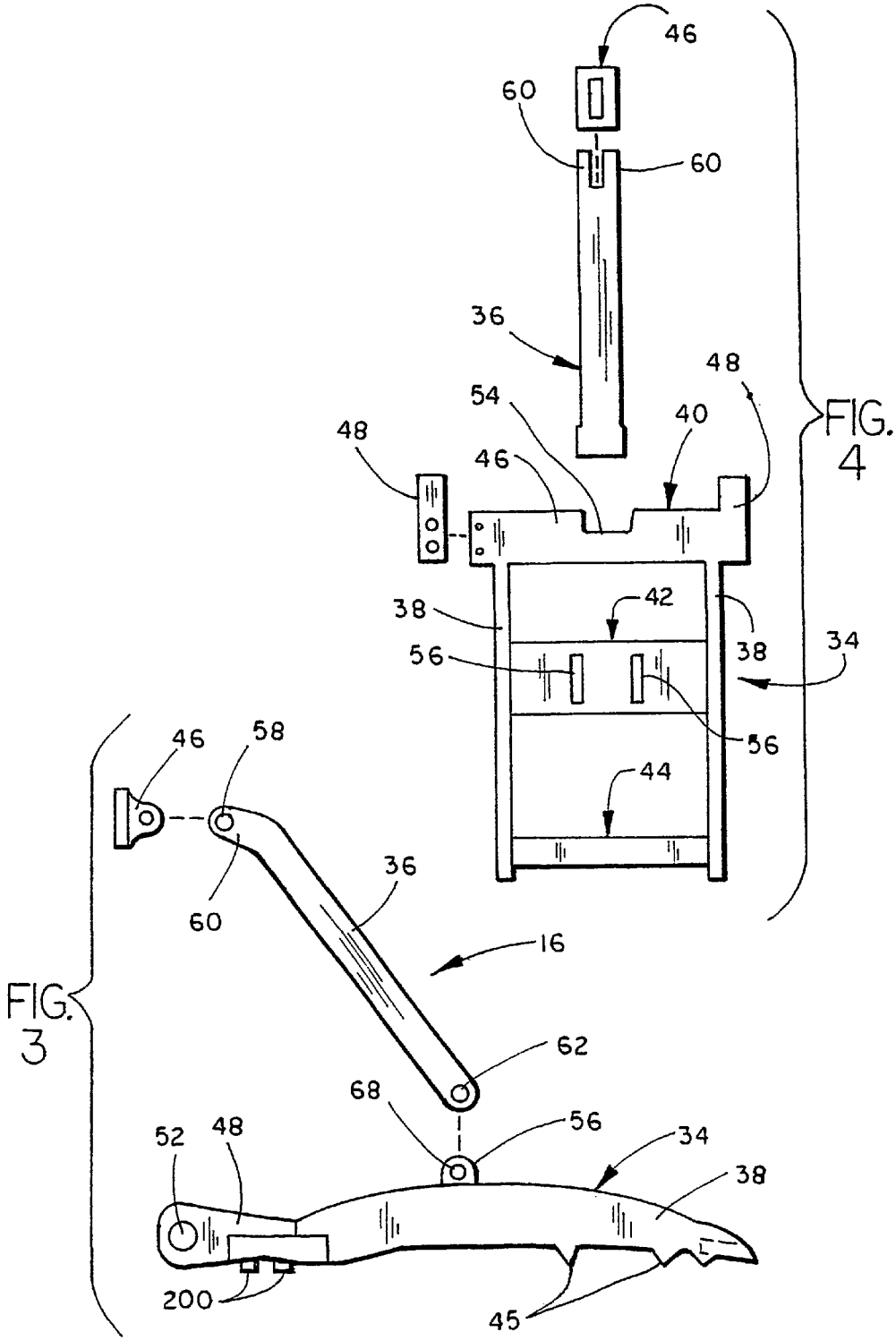
FIG. 3 is an exploded side view of a thumb assembly of the present invention.
FIG. 4 is an exploded top view of the thumb assembly of the present invention.

The illustrated thumb assembly 16 (FIGS. 3 and 4) is connected to the extendable linkage 12 and includes a thumb 34 rotatably connected to the second telescoping body 22 and an arm 36 rotatably connected to both the first telescoping body 20 and the thumb 34. The thumb 34 (FIG. 4) includes a pair of parallel beams 38 being connected by a first cross beam 40, a second cross beam 42 and a third cross beam 44. The beams 38 preferably are slightly curved in the longitudinal direction and include teeth 45 for grasping objects between the thumb 34 and the bucket 14. The first cross beam 40 has a substantially U-shaped configuration with a base 46 extending between the parallel beams 38 and a pair of legs 48 outside of the parallel beams 38 extending substantially parallel to the beams 38. As described in more detail below, the one of the legs 48 is bolted or otherwise removably attached to the base 46 of the first cross beam 40 outside of the parallel beams 38 for allowing the thumb 34 to be easily attached or removed from the extendible linkage 12. Bolts 200 are shown as attaching the leg 48 to the base 46 of the first cross beam 40. A pivot pin 50 is inserted through openings 52 in each of the legs 48, the bucket 14 and the end 28 of the second telescoping body 22 at the second pivot point 30 for connecting the thumb 34 to the second telescoping body 22. The thumb 34 and the bucket 14 therefore have a common axis of rotation. The base 46 of the first cross beam 40 includes a centered notch 54 facing the second telescoping body 22 for reception of the second telescoping body 22 as the thumb 34 is rotated away from the bucket 14. The second cross beam 42 extends between the beams 38 in a center portion of the thumb 34 and includes a pair of sleeves 56 for connection to the arm 36. The third cross beam 44 extends between the beams 38 at an end of the beams 38 opposite the first cross beam 40. As described in more detail below, the third cross beam 44 is used to grip objects between the bucket 14 and the thumb 34.

The illustrated arm 36 is an elongated shaft with a through hole 58 a first end and a pair of sleeves 60 at a second end. The sleeves 60 each include an opening 62 having a common axis that is parallel to the through hole 58 at the first end of the arm 36. A pin 64 (FIGS. 1 and 2) is inserted though an opening 65 in a shoulder 66 connected to an end of the first telescoping body 20 and the through hole 58 of the arm 36 to pivotally connect the arm 36 to the first telescoping body 20. A pin 66 (FIGS. 1 and 2) is also inserted through the sleeves 60 of the arm 36 and an opening 68 in the pair of sleeves 56 on the second cross beam 42 of the thumb 34 to pivotally connect the arm 36 to the thumb 34. The arm 36 forces the thumb 34 to pivot about the second pivot point 30.

Figure 2:
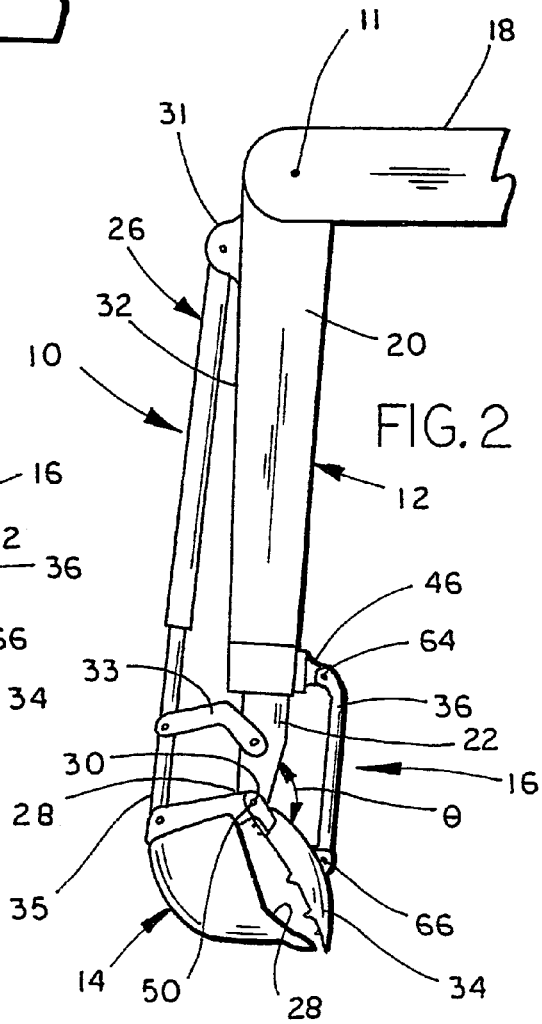
FIG. 2 is side view of the boom connected to the digging implement in a partially extending position of the present invention.

In operation, the thumb 34 is pivoted relative to the second telescoping body 22 about the second pivot point 30 by extending the linkage 12. As seen in FIG. 2, the third cross beam 44 of the thumb 34 is adjacent the bucket 14 when the linkage 12 is in a fully retracted position. When the linkage 12 is in the fully retracted position, an angle θ between the thumb 34 and the second telescoping body 22 is at its largest value. As the second telescoping body 22 telescopes out of the first telescoping body 20, the thumb 34 will rotate away from the bucket 14. Since the distance between the second pivot point 30 and the pin 64 connecting the thumb 34 to the arm 36 and the distance between the pin 64 connecting the thumb 34 to the arm 36 and the pin 66 connecting the arm 36 to the first telescoping body 20 are constant, the angle θ between the thumb 34 and the second telescoping body 22 will get smaller as the second pivot point 30 moves away from the pin 66 connecting the arm 36 to the first telescoping body 20. Therefore, the arm 36 will force the thumb 34 to rotate away from the second telescoping arm 22. When the linkage 12 is a fully extended position, third cross beam 44 of the thumb 34 will be at its farthest position from the bucket 14. Likewise, the arm 36 will force the thumb 34 of the thumb assembly 16 towards the bucket 14 as the second telescoping body 22 slides into the first telescoping body 20 because the angle α between the thumb 34 and the second telescoping body 22 will get larger as the second pivot point 30 moves towards the pin 66 connecting the arm 36 to the first telescoping body 20. Therefore, the thumb 34 of the thumb assembly 16 is forced about the second pivot point 30 as the first 20 and second 22 telescoping bodies telescope.

The illustrated bucket 14 and thumb assembly 16 of the digging implement 10 can be used to grasp objects between the bucket 14 and the thumb 34 of the thumb assembly 16 by first creating an opening 100 (as seen in FIG. 1) between the thumb 34 and the bucket 14 and placing an object within the opening 100. The object can then be grasped by the digging implement 10 by either rotating the bucket 14 towards the thumb 34 or by rotating the thumb 34 towards the bucket 14 by extending the linkage 12. The object can also be raised or lowered by rotating the linkage 12 relative to the boom 18 and moved by moving the mobile powered tractor.

An advantage of the illustrated thumb assembly 16 is that the thumb assembly 16 can be retrofitted to operate on a backhoe already having the extendable linkage 12 and the bucket 14. First, the shoulder 66 can be welded or otherwise attached to the first telescoping body 20. Second, a pin connecting the bucket 14 to the second telescoping body 22 could be removed and a new pin 50 could be inserted through the thumb 34, the bucket 14 and the second telescoping body 22 to replace the old pin. Third, the arm 36 can be connected to the thumb 34 and the shoulder 66 by inserting the pin 64 though the opening 65 in the shoulder 66 and the through hole 58 of the arm 36 to pivotally connect the arm 36 to the first telescoping body 20. Finally, the pin 66 is inserted through the sleeves 60 of the arm 36 and the opening 68 in the pair of sleeves 56 on the second cross beam 42 of the thumb 34 to pivotally connect the arm 36 to the thumb 34. It is noted that the order of the steps for connecting the thumb assembly 16 to the linkage 12 can be rearranged.

Figure 5:
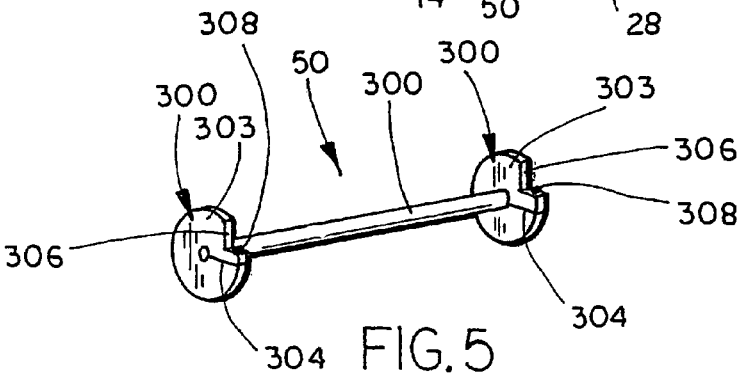
FIG. 5 is a perspective view of a rod used to connect the thumb assembly to an extendible linkage of the present invention.

Another advantage of the thumb assembly 16 is that the thumb 34 and the arm 36 can be easily attached and removed from the extendible linkage 12. As seen in FIG. 5, the pin 50 used to inserted through the thumb 34, the bucket 14 and the second telescoping body 22 includes a pair of collars 300 on each end of a cylindrical rod 302 of the pin 50. The collars 300 each comprise a ring 303 with a radial split 304 from the inner diameter of the ring 303 to the outer diameter of the ring 303. The collars also include a beveled surface 306 with an opening for acceptance of a screw 308 or other fastener that extends across the split 304 in the ring 303 of the collar 300. As the screw 308 is screwed into the opening in the beveled surface 306, the ring 300 will be compressed about the split 304 in order to positively connect the collar 300 to the rod 302. Therefore, the pin 50 can be attached to the bucket 14 and the second telescoping body 22 by removing one of the collars 300 from one side of the rod 302. The rod 302 is then extended through the bucket 14 and the second telescoping body 22. Therefore, the screws 308 of the collars 300 are loosened and the collars 300 are centered on the rod 302 outside of the bucket 14 and the second telescoping body 22. Consequently, the rod 302 will have a pair of cylindrical ends extending outside of each of the collars 300. Thereafter, the thumb 34 can be easily attached to the pin 50 by first removing one of the legs 48 of the first cross beam 40 of the thumb 34. One of the cylindrical ends of the rod 302 outside of the collars 300 is then inserted into the opening 52 on the leg 48 of the first cross beam 40 that is attached to the thumb 34. The other of the cylindrical ends of the rod 302 outside of the collars 300 is inserted into the opening 52 on the leg 48 that is removed from the first cross beam 40 of the thumb 34. The removable leg 48 is then attached to the thumb 34 with the bolts 200 in order to positively connect the thumb 34 to the pin 50 and the second telescoping body 22. Moreover, the pin 64 connecting the arm 36 to the first telescoping body 20 and the pin 66 are common removable pins that includes a fixed collar on one end and a removable cam over pin clip on the other end. Therefore, the pin 64 and the pin 66 can be easily removed. Consequently, the arm 36 can be easily removed from the first telescoping body 20 and the thumb 34. In this manner, only the pin 50 and the shoulder 66 would remain attached to the linkage 12 when the thumb assembly 16 is removed. The thumb assembly 16 can therefore be easily attached and removed from the linkage 12 when the bucket 14 is to be used for digging only and for other purposed when the thumb assembly 16 is not required.

The above description is that of the preferred embodiments only. Modifications of the invention will occur to those skilled in the art and to those who make or use the invention. For example, it is contemplated that the extendible linkage 12 could include a pair of bodies that extend in a manner other than telescoping (e.g., the bodies of the extendible linkage could slide relative to one another wherein one of the bodies is not located within the other body). Therefore, it is understood that the embodiment described above is merely for illustrative purposes and not intended to limit the scope of the invention, which is defined by the following claims as interpreted according to the principles of patent law, including the Doctrine of Equivalents.

The invention claimed is:

1. A digging implement comprising:

an extendable linkage including a bucket; and a thumb assembly pivotally connected to a first member of said linkage and pivotally connected to a second member of said linkage, displaceable relative to said first member, for holding materials in said bucket, wherein said thumb assembly is configured to rotate as said linkage extends, and both said bucket and said thumb assembly are independently operable.

2. The digging implement as recited in claim 1, wherein:

said extendable linkage includes a first telescoping body and a second telescoping body, said linkage being configured to elongate as said first and second telescoping bodies telescope, said bucket being rotatably connected to the second telescoping body.

3. A digging implement comprising:

an extendable linkage including a bucket and a thumb assembly for holding materials in said bucket, wherein said thumb assembly is configured to rotate as said linkage extends, and both said bucket and said thumb assembly are independently operable;

wherein said extendable linkage includes a first telescoping body and a second telescoping body, said linkage being configured to elongate as said first and second telescoping bodies telescope and said bucket being rotatably connected to the second telescoping body;

wherein said thumb assembly includes a thumb rotatably connected to the second telescoping body and an arm rotatably connected to said firs telescoping body and said thumb; and wherein said arm will force said thumb to rotate about said second telescoping body as said first and second telescoping bodies telescope.

4. The digging implement as recited in claim 3, wherein:

said bucket and said thumb are rotatably connected to an end of the second telescoping body, said bucket and said thumb having a common axis of rotation.

5. The digging implement as recited in claim 4, wherein:

said arm is rotatably connected to an end of said first telescoping body and to a center portion of said thumb on a side of said thumb opposite said bucket.

6. The digging implement as recited in claim 5, wherein:

said thumb includes a pair of parallel beams with a first cross beam for connection to said second telescoping body, a second cross beam for connection to said arm and a third cross beam for gripping objects between said bucket and said thumb.

7. The digging implement as recited in claim 6, wherein:

said U-shaped first cross beam includes a base extending between said pair of parallel beams and a pair of legs extending outside of the pair of parallel beams, one of said legs being removably attached to aid base for allowing said thumb to be easily attached to and removed from said linkage.

8. The digging implement as recited in claim 1, wherein:

said bucket and said thumb assembly are rotatably connected to an end of said extendable linkage at a pivot point.

9. In a digging implement having a linkage including a first telescoping body and a second telescoping body displaceable relative to said first telescoping body, said linkage configured to elongate as said first and second telescoping bodies telescope, and a bucket rotatably connected to an end of said second telescoping body, the improvement comprising:

a thumb assembly rotatably connected to said end of said second telescoping body at a pivot point and to an end of said first telescoping body;

wherein said thumb assembly is forced about said pivot point as said first and second telescoping bodies telescope, and both said bucket and said thumb assembly are independently operable.

10. In a digging implement having a linkage including a first telescoping body and a second telescoping body, said linkage configured to elongate as said first and second telescoping bodies telescope, and a bucket rotatably connected to an end of said second telescoping body, the improvement comprising:

a thumb assembly rotatably connected to said end of said second telescoping body at a pivot point and to an end of said first telescoping body;

wherein said thumb assembly is forced about said pivot point as said first and second telescoping bodies telescope, and both said bucket and said thumb assembly are independently operable;

wherein said thumb assembly includes a thumb rotatably connected to the second telescoping body and an arm rotatably connected to said first telescoping body and said thumb; and wherein said arm will force said thumb to rotate about said second telescoping body as said first and second telescoping bodies telescope.

11. The digging implement as recited in claim 10, wherein:

said bucket and said thumb are rotatably connected to an end of the second telescoping body, said bucket and said thumb having a common axis of rotation.

12. The digging implement as recited in claim 11, wherein:

said arm is rotatably connected to an end of said first telescoping body and to a center portion of said thumb on a side of said thumb opposite said bucket.

13. The digging implement as recited in claim 12, wherein:

said thumb includes a pair of parallel beams with a first cross beam for connection to said second telescoping body, a second cross beam for connection to said arm and a third cross beam for gripping objects between said bucket and said thumb.

14. The digging implement as recited in claim 13, wherein:

said first cross beam includes a base extending between said pair of parallel beams and a pair of legs extending outside of the pair of parallel beams, one of said legs being removably attached to said base for allowing said thumb to be easily attached to and removed from said linkage.

15. The digging implement as recited in claim 9, wherein:

said bucket is rotatably connected to said second telescoping body at said pivot point.

16. A digging implement comprising:

a linkage including a first telescoping body and a second telescoping body, said linkage configured to elongate as said first and second telescoping bodies telescope;

a bucket connected to an end of said second telescoping body; and a thumb assembly rotatably connected to said end of said second telescoping body at a pivot point and to an end of said first telescoping body;

wherein said thumb assembly is forced about said pivot point as said first and second telescoping bodies telescope, and both said bucket and said thumb assembly are independently operable.

17. A digging implement comprising:

a linkage including a first telescoping body and a second telescoping body, said linkage configured to elongate as said first and second telescoping bodies telescope;

a bucket connected to an end of said second telescoping body; and a thumb assembly rotatably connected to said end of said second telescoping body at a pivot point and to an end of said first telescoping body;

wherein said thumb is forced about said pivot point as said first and second telescoping bodies telescope, and both said bucket and said thumb are independently operable;

wherein said thumb assembly includes a thumb rotatably connected to the second telescoping body and an arm rotatably connected to said first telescoping body and said thumb; and wherein said arm will force said thumb to rotate about said second telescoping body as said first and second telescoping bodies telescope.

18. The digging implement as recited in claim 17, wherein:

said bucket and said thumb are rotatably connected to an end of the second telescoping body, said bucket and said thumb having a common axis of rotation.

19. The digging implement as recited in claim 18, wherein:

said arm is rotatably connected to an end of said first telescoping body and to a center portion of said thumb on a side of said thumb opposite said bucket.

20. The digging implement as recited in claim 17, wherein:

said thumb includes a pair of parallel beams with a first cross beam for connection to said second telescoping body, a second cross beam for connect to said arm and a third cross beam for gripping objects between said bucket and said thumb.

21. The digging implement as recited in claim 20, wherein:

said U-shaped first cross beam includes a base extending between said pair of parallel beams and a pair of legs extending outside of the pair of parallel beams, one of said legs being removably attached to said base for allowing said thumb to be easily attached to and removed from said linkage.

22. The digging implement as recited in claim 16, wherein:

said bucket is rotatably connected to said second telescoping body at said pivot point.

23. A thumb assembly for connection for a digging implement having a linkage including a first telescoping body and a second telescoping body, the linkage configured to elongate as the first and second telescoping bodies telescope, the digging implement also including a bucket connected to an end of the second telescoping body, the thumb assembly comprising:

a thumb configured for rotatable connection to the second telescoping body; and an arm configured for rotatable connection to the first telescoping body and the thumb;

wherein the arm will force said thumb, when both said arm and said thumb are connected to the digging implement, to rotate about the second telescoping body as the first and second telescoping bodies telescope; and wherein both the thumb and the bucket are independently operable when both said arm and said thumb are connected to the digging implement.

24. The thumb assembly as recited in claim 23, wherein: said thumb is configured to be rotatably connected to an end of the second telescoping body, wherein said bucket and said thumb would have a common axis of rotation.

25. The thumb assembly as recited in claim 24, wherein: said arm is configured to be rotatably connected to an end of said first telescoping body and to a center portion of said thumb on a side of said thumb opposite said bucket.

26. The thumb assembly as recited in claim 23, wherein: said thumb includes a pair of parallel beams with a first cross beam for connection to the second telescoping body, a second cross beam for connection to said arm and a third cross beam for gripping objects between the bucket and said thumb.

27. The thumb assembly as recited in claim 26, wherein: said first cross beam includes a base extending between said pair of parallel beams and a pair of legs extending outside of the pair of parallel beams, one of said legs being removably attached to said base for allowing said thumb to be easily attached to and removed from said linkage.

28. The thumb assembly as recited in claim 23, further including:

a shoulder configured to attachment to the first telescoping body, said shoulder for rotatably connecting said arm to said first telescoping body.

29. A method of connecting a thumb assembly to a digging implement having a linkage including a first telescoping body and a second telescoping body, the linkage configured to elongate as the first and second telescoping bodies telescope, the digging implement also including a bucket connected at a pivot point to an end of the second telescoping body, the method comprising:

rotatably connecting a thumb to said second telescoping body at the pivot point; and rotatably connecting an arm to said first telescoping body and said thumb;

wherein the arm will force said thumb, when both said arm and said thumb are connected to the digging implement, to rotate about he second telescoping body as the first and second telescoping bodies telescope; and wherein both the thumb and the bucket are independently operable when both said arm and said thumb are connected to the digging implement.

30. A digging machine comprising:

a mobile base;

an extendable linkage connected at a first end to the mobile base and at a second end to a bucket; and a thumb assembly pivotally connected to a first member of said linkage and pivotally connected to a second member of said linkage, displaceable relative to said first member for holding materials in said bucket, wherein said thumb assembly is configured to rotate as said linkage extends, and both said bucket and said thumb assembly are independently operable.

31. The digging machine as recited in claim 30, wherein: said extendable linkage includes a first telescoping body and a second telescoping body, said linkage being configured to elongate as said first and second telescoping bodies telescope, said bucket being rotatably connected to the second telescoping body.

32. The digging machine as recited in claim 30, wherein: said bucket and said thumb assembly are rotatably connected to an end of said extendable linkage at a pivot point.

33. In a digging machine having a mobile base and a linkage connected to the mobile base, the linage including a first telescoping body connected to the mobile base and a second telescoping body, said linkage configured to elongate as said first and second telescoping bodies telescope, and a bucket rotatably connected to an end of said second telescoping body, the improvement comprising:

a thumb assembly rotatably connected to said end of said second telescoping body at a pivot point and to an end of said first telescoping body;

wherein said thumb assembly is forced about said pivot point as said first and second telescoping bodies telescope, and both said bucket and said thumb assembly are independently operable.

34. The digging machine as recited in claim 33, wherein: said thumb assembly includes:

a thumb rotatably connected to the second telescoping body; and an arm rotatably connected to said first telescoping body and said thumb;

wherein said arm will force said thumb to rotate about said second telescoping body as said first and second telescoping bodies telescope.

35. The digging machine as recited in claim 33, wherein: said bucket is rotatably connected to said second telescoping body at said pivot point.

36. A digging machine comprising:

a mobile base;

a linkage including a first telescoping body connected to the mobile base and a second telescoping body, said linkage configured to elongate as said first and second telescoping bodies telescope;

a bucket connected to an end of said second telescoping body; and a thumb assembly rotatably connected to said end of said second telescoping body at a pivot point and to an end of said first telescoping body;

wherein said thumb assembly is forced about said pivot point as said first and second telescoping bodies telescope, and both said bucket and said thumb assembly are independently operable.

37. The digging machine as recited in claim 36, wherein: said thumb assembly includes:

a thumb rotatably connected to the second telescoping body; and an arm rotatably connected to said first telescoping body and said thumb;

wherein said arm will force said thumb to rotate about said second telescoping body as said first and second telescoping bodies telescope.

38. The digging machine as recited in claim 37, wherein: said bucket and said thumb are rotatably connected to an end of the second telescoping body, said bucket and said thumb having a common axis of rotation.

39. The digging machine as recited in claim 37, wherein: said thumb includes a pair of parallel beams with a U-shaped first cross beam for connection to said second telescoping body, a second cross beam for connection to said arm and a third cross beam for gripping objects between said bucket and said thumb.

40. The digging machine as recited in claim 36, wherein: said bucket is rotatably connected to said second telescoping body at said pivot point.

41. A digging implement comprising:

an extendable linkage including a bucket; and a thumb assembly pivotally connected to a first member of said linkage and pivotally connected to a second member of said linkage, displaceable relative to said first member for holding materials in said bucket, wherein said thumb assembly is configured to rotate as said linkage extends;

wherein both said bucket and said thumb assembly are independently operable; and wherein said thumb assembly is removably connected to said extendable linkage.

42. The digging implement as recited in claim 41, wherein:

said extendable linkage includes a first telescoping body and a second telescoping body, said linkage being configured to elongate as said first and second telescoping bodies telescope, said bucket being rotatably connected to the second telescoping body.

43. The digging implement as recited in claim 42, wherein:

said thumb assembly includes:

a thumb rotatably connected to the second telescoping body; and an arm rotatably connected to said first telescoping body and said thumb;

wherein said arm will force said thumb to rotate about said second telescoping body as said first and second telescoping bodies telescope.

44. The digging implement as recited in claim 43, wherein:

said bucket and said thumb are rotatably connected to an end of the second telescoping body, said bucket and said thumb having a common axis of rotation.

45. The digging implement as recited in claim 44, wherein:

said arm is rotatably connected to an end of said first telescoping body and to a center portion of said thumb on a side of said thumb opposite said bucket.

46. The digging implement as recited in claim 45, wherein:

said thumb includes a pair of parallel beams with a first cross beam for connection to said second telescoping body, a second cross beam for connection to said arm and a third cross beam for gripping objects between said bucket and said thumb.

47. The digging implement as recited in claim 41, wherein:

said bucket and said thumb assembly are rotatably connected to an end of said extendable linkage at a pivot point.

48. The digging implement as recited in claim 41, wherein:

said bucket is removably connected to said extendable linkage with a pivot pin; and said pivot pin includes a removable collar for allowing said pivot pin to be removed from said bucket and said extendable linkage.

49. In a digging implement having a linkage including a first telescoping body and a second telescoping body, said linkage configured to elongate as said first and second telescoping body, said linkage configured to elongate as said first and second telescoping bodies telescope, and a bucket rotatably connected to an end of said second telescoping body, the improvement comprising:

a thumb assembly rotatably connected to said end of said second telescoping body at a pivot point and to an end of said first telescoping body;

wherein said thumb assembly is forced about said pivot point as said first and second telescoping bodies telescope, and both said bucket and said thumb assembly are independently operable;

wherein said thumb assembly is removably connected to said second telescoping body and to said first telescoping body.

50. The digging implement as recited in claim 49, wherein:

said thumb assembly includes:

a thumb rotatably connected to the second telescoping body; and an arm rotatably connected to said first telescoping body and said thumb;

wherein said arm will force said thumb to rotate about said second telescoping body as said first and second telescoping bodies telescope.

51. The digging implement as recited in claim 50, wherein:

said bucket and said thumb are rotatably connected to an end of the second telescoping body, said bucket and said thumb having a common axis of rotation.

52. The digging implement as recited in claim 51, wherein:

said arm is rotatably connected to an end of said first telescoping body and to a center portion of said thumb of a side of said thumb opposite said bucket.

53. The digging implement as recited in claim 52, wherein:

said thumb includes a pair of parallel beams with a first cross beam for connection to said second telescoping body, a second cross beam for connection to said arm and a third cross beam for gripping objects between said bucket and said thumb.

54. The digging implement as recited in claim 49, wherein:

said bucket is rotatably connected to said second telescoping body at said pivot point.

55. The digging implement as recited in claim 49, wherein:

said bucket is removably connected to said second telescoping body with a pivot pin; and said pivot pin includes a removable collar for allowing said pivot pin to be removed from said bucket and said second telescoping body.

56. The digging implement comprising:

a linkage including a first telescoping body and a second telescoping body, said linkage configured to elongate as said first and second telescoping bodies telescope;

a bucket connected to an end of said second telescoping body; and a thumb assembly rotatably connected to said end of said second telescoping body at a pivot point and to an end of said first telescoping body;

wherein said thumb assembly is forced about said pivot point as said first and second telescoping bodies telescope, and both said bucket and said thumb assembly are independently operable; and wherein said thumb assembly is removably connected to said second telescoping body and to said first telescoping body.

57. The digging implement as recited in claim 56, wherein:

said thumb assembly includes:

a thumb rotatably connected to the second telescoping body; and an arm rotatably connected to said first telescoping body and said thumb;

wherein said arm will force said thumb to rotate about said second telescoping body as said first and second telescoping bodies telescope.

58. The digging implement as recited in claim 57, wherein:

said bucket and said thumb are rotatably connected to an end of the second telescoping body, said bucket and said thumb having a common axis of rotation.

59. The digging implement as recited in claim 58, wherein:

said arm is rotatably connected to an end of said first telescoping body and to a center portion of said thumb on a side thumb on a side of said thumb opposite said bucket.

60. The digging implement as recited in claim 57, wherein:

said thumb includes a pair of parallel beams with a first cross beam for connection to said second telescoping body, a second cross beam for connection to said arm and a third cross beam for gripping objects between said bucket and said thumb.

61. An assembly comprising:

a first arm member supportable on a base member;

a second arm member mounted on and displaceable relative to said first arm member;

an implement pivotally connected to said second arm member;

first means for displacing said second arm member relative to said first arm member;

second means for displacing said implement relative to said second arm member;

a third arm member pivotally connect to said second arm member, cooperable with said implement for gripping objects therebetween; and a link pivotally connected to said first arm member and pivotally connected to said third arm member.

62. An assembly according to claim 61 wherein said first displacing means includes a fluid actuated cylinder assembly.

63. An assembly according to claim 62 wherein said second displacing means includes a fluid actuated cylinder assembly.

64. An assembly according to claim 63 wherein the cylinder of said second displacing means is pivotally connected to said first arm member.

65. An assembly according to claim 61 including a second link member pivotally connected to said second arm member and pivotally connected to said second displacing means, and a third link member pivotally connected to said second link member and pivotally connected to said implement.

66. An assembly according to claim 65 wherein at least a portion of said second arm member, said second and third link members and at least a portion of said implement form a four bar linkage.

67. An assembly according to claim 61 wherein said first mentioned link member is pivotally connected to an end of said first arm member.

68. An assembly according to claim 61 wherein said first mentioned link member is pivotally connected to said third arm member at a point intermediate the ends thereof.

69. An assembly according to claim 61 wherein said implement comprises a bucket.

70. An assembly according to claim 69 wherein said bucket includes an opening disposed in opposed relation to said third arm member.

71. An assembly according to claim 61 wherein said third arm ember includes material engaged teeth portions.

72. An assembly according to claim 61 wherein said implement and said third arm member have a common pivot arm.

73. An assembly according to claim 72 wherein said common pivot axis is disposed at an end of said second arm member.

74. An assembly according to claim 61 wherein said first and second arm members are telescopically connected together.

75. An assembly according to claim 74 wherein said second arm member is telescopically received in said first arm member.

76. A machine comprising:

a mobile base assembly;

a first arm member operatively connected to said mobile base assembly;

a second arm member mounted on and displaceable relative to said first arm member;

an implement pivotally connected to said second arm member;

first means for displacing said second arm member relative to said first arm member;

second means for displacing said implement relative to said second arm member;

a third arm member pivotally connected at one end thereof to an underside of said second arm member, cooperable with said implement for gripping objects therebetween; and a link pivotally connected to said first arm member and pivotally connected to said third arm member.

77. A machine according to claim 76 wherein said second displacing means comprises a fluid actuated cylinder assembly having the cylinder thereof pivotally connected to said first arm member.

78. A machine according to claim 76 wherein said first and second arm members are telescopically connected together.

79. A machine according to claim 78 wherein said second arm member is telescopically received in said first arm member.

80. A machine according to claim 76 wherein said link is pivotally connected to said first arm member at an end thereof and pivotally connected to said third arm member intermediate the ends thereof.

81. An attachment for an assembly including a first arm member operatively connected to a mobile base assembly, a second arm mounted on and displaceable relative to said first arm member, an implement pivotally connected to said second arm member, first means for displacing said second arm member relative to said first arm member and second means for displacing said implement relative to said second arm member, comprising:

a third arm member pivotally connectable to an underside of said second arm member; and a link connectable at one end thereof to an underside of said first arm member and pivotally connected at another end thereof to said third arm member intermediate the ends thereof.

82. An attachment according to claim 81 wherein said third arm member is provided with a set of teeth for gripping an object between said implement and said third arm member.

83. An attachment according to claim 81 wherein said third arm member is connectable to said second arm member on a common pivot axis with said implement, and said link is connectable to an end of said first arm member.

* * * * *